US011162264B2

(12) United States Patent
Jorgenson et al.

(10) Patent No.: US 11,162,264 B2
(45) Date of Patent: Nov. 2, 2021

(54) METHOD AND APPARATUS FOR INSTALLATION OF ROOF EQUIPMENT

(71) Applicant: ACTIVAR CONSTRUCTION PRODUCTS GROUP, INC., Minneapolis, MN (US)

(72) Inventors: James P. Jorgenson, Lester Prairie, MN (US); Alec G. Agate, Eden Prairie, MN (US)

(73) Assignee: Activar Construction Products Group, Inc., Minneapolis, MN (US)

( * ) Notice: Subject to any disclaimer, the term of this patent is extended or adjusted under 35 U.S.C. 154(b) by 0 days.

(21) Appl. No.: 15/924,094

(22) Filed: Mar. 16, 2018

(65) Prior Publication Data

US 2018/0266116 A1 Sep. 20, 2018

Related U.S. Application Data

(60) Provisional application No. 62/473,004, filed on Mar. 17, 2017.

(51) Int. Cl.

| | |
|---|---|
| ***E04D 13/14*** | (2006.01) |
| ***E04D 5/14*** | (2006.01) |
| ***E04D 13/03*** | (2006.01) |
| ***E04D 13/147*** | (2006.01) |
| *E04D 5/00* | (2006.01) |

(52) U.S. Cl.

CPC ..... *E04D 13/1415* (2013.01); *E04D 5/146* (2013.01); *E04D 13/03* (2013.01); *E04D 13/0315* (2013.01); *E04D 13/14* (2013.01); *E04D 13/1475* (2013.01); *E04D 5/00* (2013.01)

(58) Field of Classification Search

CPC . E04D 13/1415; E04D 13/1475; E04D 13/14; E04D 13/0315; E04D 13/03; E04D 5/146; E04D 13/031

See application file for complete search history.

(56) References Cited

U.S. PATENT DOCUMENTS 2,702,514 A * 2/1955 Dalley ..... E04D 13/1415 52/61
3,187,464 A * 6/1965 Sharp ..... E04D 13/15 52/716.1
3,277,618 A * 10/1966 Smith ..... E04D 13/1415 52/58
4,781,008 A 11/1988 Lyons, Jr.
(Continued)

*Primary Examiner* — Jessie T Fonseca
(74) *Attorney, Agent, or Firm* — Schwegman Lundberg & Woessner, P.A.

(57) ABSTRACT

The present subject matter provides apparatus for connecting a roof assembly to a membrane using at least one backer rod connected to the membrane, including: counterflashing disposed about the perimeter of the roof assembly, the counterflashing including a plurality of grips configured to receive and engage the at least one backer rod in contact with the membrane, so as to hold the membrane securely in position and maintain a weather seal at a desired flashing height of the membrane. In various examples, the roof assembly includes a roof hatch, window, or other fenestration unit. In various examples, the present subject matter provides a hatch attached to a wall for sealing an opening. In various examples, the present subject matter provides a method for operating a roof assembly for connection to a roof membrane.

23 Claims, 7 Drawing Sheets

(56) References Cited

U.S. PATENT DOCUMENTS

| | | | | | |
|---|---|---|---|---|---|
| 4,941,300 | A * | 7/1990 | Lyons, Jr. | E04D 13/0315 | 52/200 |
| 5,148,981 | A * | 9/1992 | Lynch, Jr. | E01B 9/306 | 238/14.14 |
| 5,263,287 | A * | 11/1993 | Lyons, Jr. | E04D 13/1415 | 52/395 |
| 5,553,425 | A * | 9/1996 | Sampson | E04D 13/0315 | 52/198 |
| 5,960,596 | A * | 10/1999 | Lyons, Sr. | E04D 13/1415 | 52/198 |
| 8,176,688 | B1 * | 5/2012 | Smith | E04B 1/7046 | 52/58 |
| 10,214,909 | B1 * | 2/2019 | Bregenzer | E04D 5/146 | |
| 2009/0000239 | A1 * | 1/2009 | Hamlin, III | E04D 13/1415 | 52/741.4 |
| 2018/0106044 | A1 * | 4/2018 | Pendley | E04D 13/0315 | |

* cited by examiner

METHOD AND APPARATUS FOR INSTALLATION OF ROOF EQUIPMENT

CLAIM OF BENEFIT AND INCORPORATION BY REFERENCE

This application claims the benefit of U.S. Provisional Patent Application Ser. No. 62/473,004 filed Mar. 17, 2017, entitled "Method and Apparatus for Installation of Roof Equipment," and which is hereby incorporated by reference in its entirety.

TECHNICAL FIELD

The present disclosure pertains to methods and apparatus for installation of roof equipment.

BACKGROUND

Frame assemblies for building openings, such as a roof hatches or scuttles, have been proposed by others, such as in U.S. Pat. No. 4,781,008 to Lyons, Jr. Such assemblies require special tools to connect the roof membrane to the opening structure, and/or complicated procedures and hardware for connecting the roof membrane to the structure.

There is a need in the art for methods and apparatus for straightforward and rapid assembly of roofing materials to roofing structures.

SUMMARY

The present subject matter provides apparatus and method to more efficiently connect roof structures to roofing membranes to ensure waterproof connections that are straightforward and require fewer tools for installation.

In various embodiments, the present subject matter provides apparatus for connecting a roof assembly to a membrane using at least one backer rod connected to the membrane, including: counterflashing disposed about the perimeter of the roof assembly, the counterflashing including a plurality of grips configured to receive and engage the at least one backer rod in contact with the membrane, so as to hold the membrane securely in position and maintain a weather seal at a desired flashing height of the membrane. In various embodiments, at least some of the plurality of grips include detents to hold at least some of the at least one backer rod. In various embodiments, at least some of the plurality of grips include multiple detents to hold at least some of the at least one backer rod at different heights and/or different tensions. In various embodiments, the detents include a manually operable portion to allow for release of tension on the at least some of the at least one backer rod for removal. A variety of backer rod materials may be employed in various embodiments. In embodiments where the grips are relatively fixed, the backer rod can be made of a flexible or compressible material so as to allow the backer rod to be placed into the grips and hold the membrane in place. In embodiments where the grips are more flexible, a more rigid backer rod can be inserted into the grips to hold the membrane in place. A person of skill in the art will appreciate that the grips and backer rod can be selected to allow for a firm hold on the membrane, and to allow for removal of the backer rod as needed to release the membrane from the roof structure. Thus, the grips and backer rod can be made of different dimensions and materials in various embodiments.

In various embodiments, at least some of the plurality of grips include a ramped edge to allow the at least one backer rod to snap into place and to hold the backer rod. In various embodiments, different materials can be used for the counterflashing. In some embodiments, at least a portion of the counterflashing includes metal. In various embodiments, different attachment means may be employed. In some embodiments at least a portion of the counterflashing is screwed to the roof assembly. In various embodiments, the roof assembly includes a roof hatch, window, or other fenestration unit.

In various embodiments, the present subject matter provides a hatch attached to a wall forming an opening in an open state, and sealing the opening in a closed state, the hatch configured to at least partially engage with a portion of the wall comprising a counterflashing configured to receive and hold at least one backer rod connected to a roof membrane, the counterflashing disposed about the perimeter of the roof assembly, the counterflashing including a plurality of grips configured to receive and engage the at least one backer rod in contact with the membrane, so as to hold the membrane securely in position and maintain a weather seal at a desired flashing height of the membrane, wherein the at least one backer rod is compressible to be inserted into the plurality of grips to hold the backer rod and membrane in position.

In various embodiments, the present subject matter provides a method for operating a roof assembly for connection to a roof membrane, comprising: gathering the roof membrane about one or more backer rods; and inserting the roof membrane and backer rods into a plurality of grips of a counterflashing disposed about a perimeter of the roof assembly so as to provide a tension and height to the roof membrane to seal the roof assembly to the roof membrane.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The inventors of the present invention sought a way to connect roofing structures to roofing materials without requiring time-consuming, complicated assembly. The inventors also sought to avoid special tools for assembly. The inventors sought a reliable and repeatable connection approach that could be employed on a variety of roofing structures.

While the examples provided in this Detailed Description demonstrate applications of the present subject matter to roof hatches, it is understood that other roofing structures may employ the present subject matter without departing from the scope of the present invention. For example, besides roof hatches, the present subject matter could be used in installation of roof drainage systems, roof fenestration units such as skylight structures, roof heating, ventilation, and air conditioning (HVAC) structures, roof power structures, chimneys, and other roof mounted and/or roof mounting structures. The applications listed herein are intended to demonstrate other potential uses of the present subject matter, but are not an exhaustive or exclusive collection of potential uses of the present subject matter.

Figure 1:
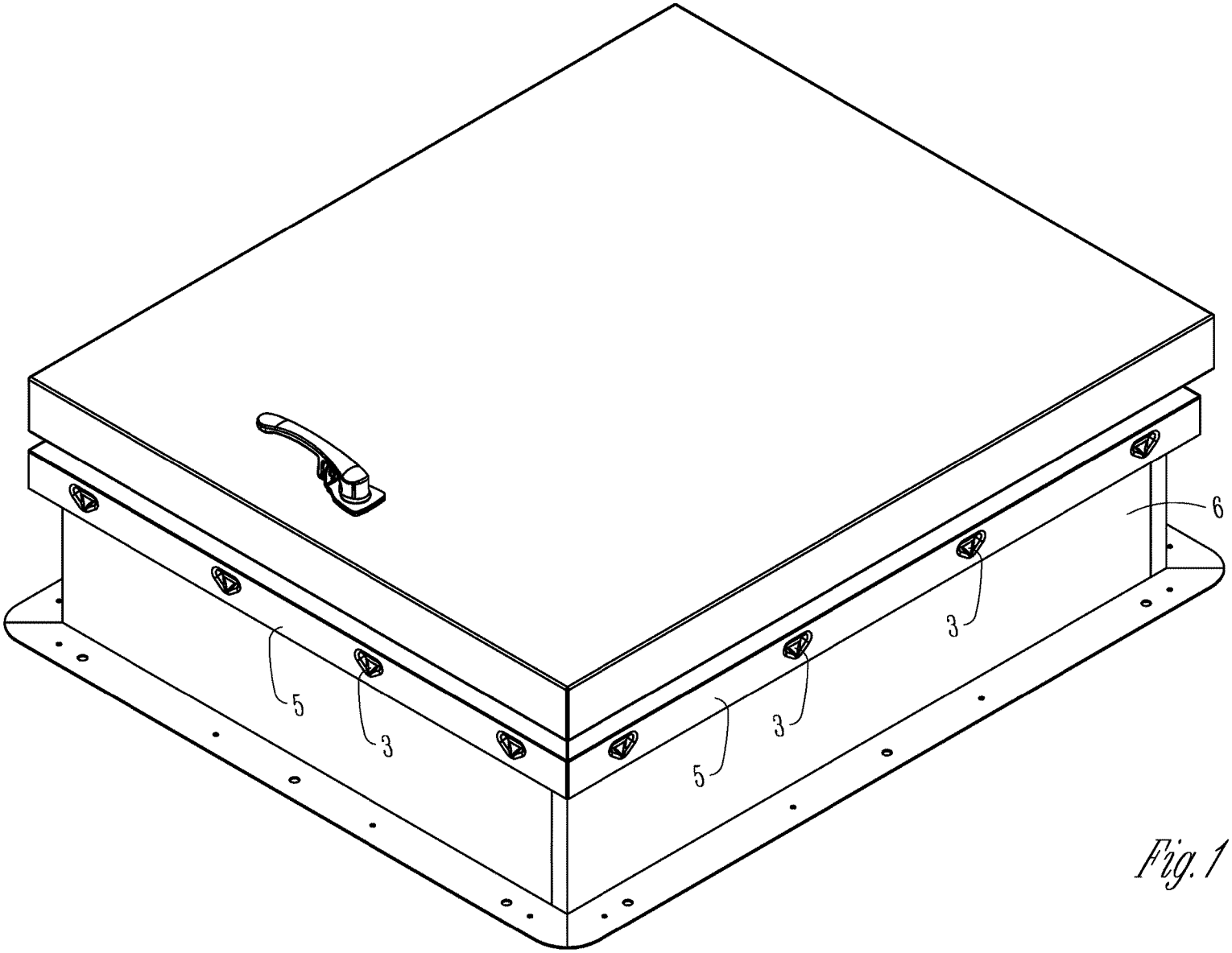
FIG. 1 is a perspective image of an improved roof hatch assembly, according to one embodiment of the present subject matter.

FIG. 1 is a perspective image of an improved roof hatch assembly, according to one embodiment of the present subject matter. The roof hatch is shown in a closed state with respect to the remaining roof structure. FIG. 1 shows an insulation 6 that encircles a lower portion of the roof hatch frame. The upper portion of the frame which is disposed adjacent the closed door includes a counterflashing 5 which encircles the outer perimeter of the opening of the frame assembly. Disposed within the counterflashing 5 are a series of grips 3 about the perimeter of the counterflashing 5.

Figure 2A:
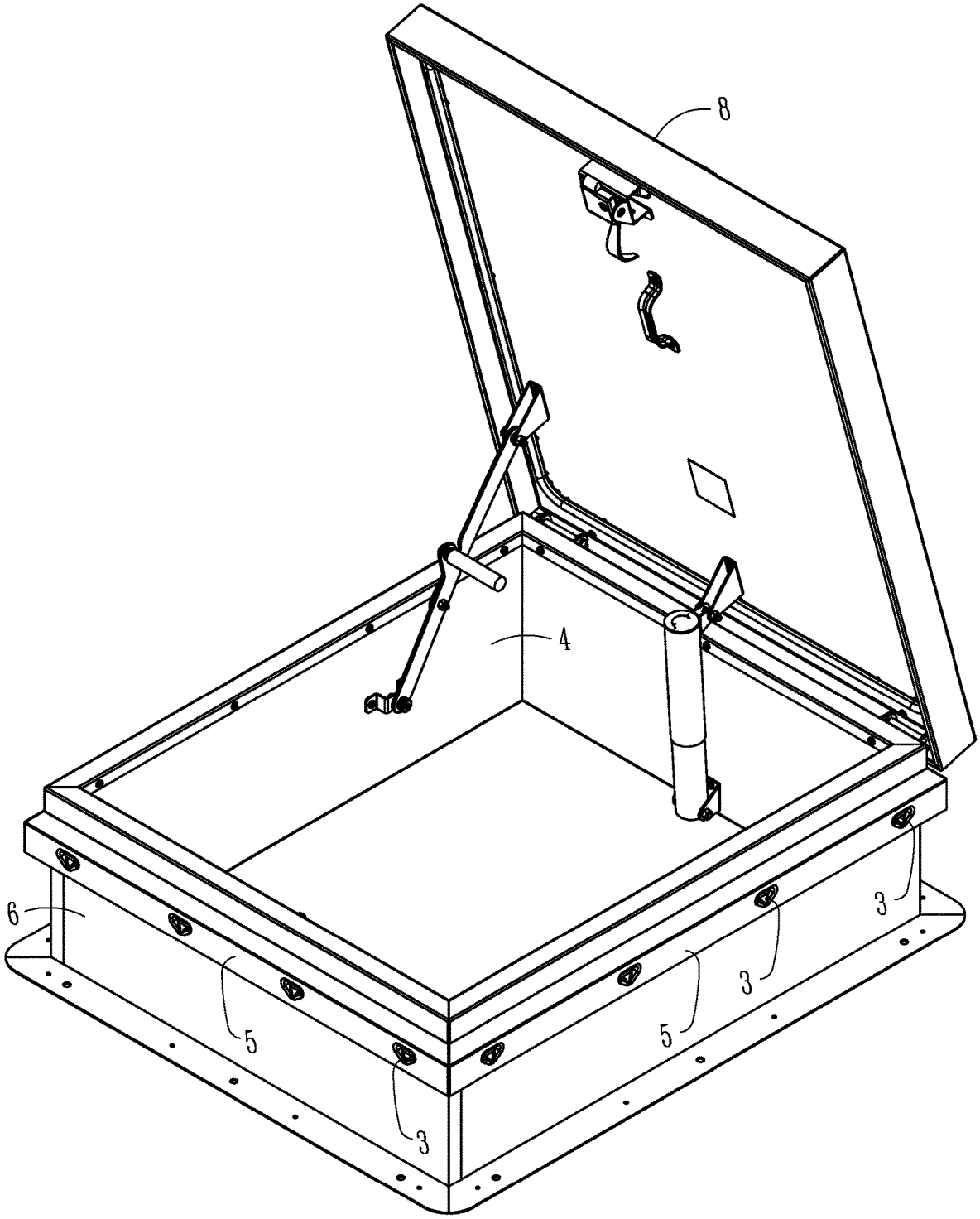
FIGS. 2A-B are perspective images of the improved roof hatch assembly of FIG. 1 with its cover open, showing a single grip embodiment (FIG. 2A) and a plurality of grips embodiment (FIG. 2B), according to various embodiments of the present subject matter.
Figure 2B:
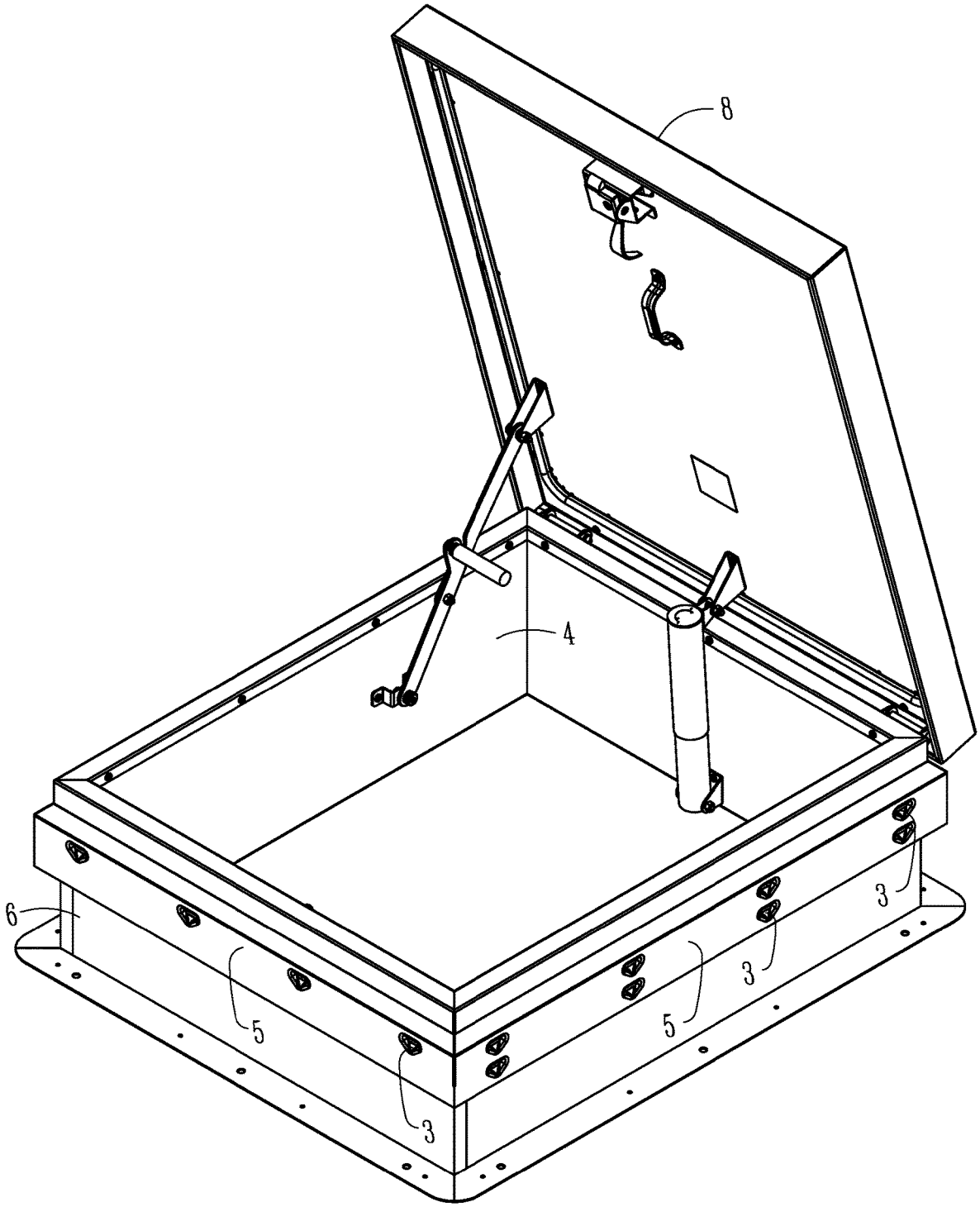

FIGS. 2A-B are perspective images of the improved roof hatch assembly of FIG. 1 with its cover open, showing a single grip embodiment (FIG. 2A) and a plurality of grips embodiment (FIG. 2B), according to various embodiments of the present subject matter. Hatch cover 8 is lifted up to show the wall or curb 4 of the hatch assembly housing that is mounted on the roof. FIGS. 2A-B show the counterflashing 5 with a plurality of grips 3 encircling the perimeter of the opening.

Figure 3A:
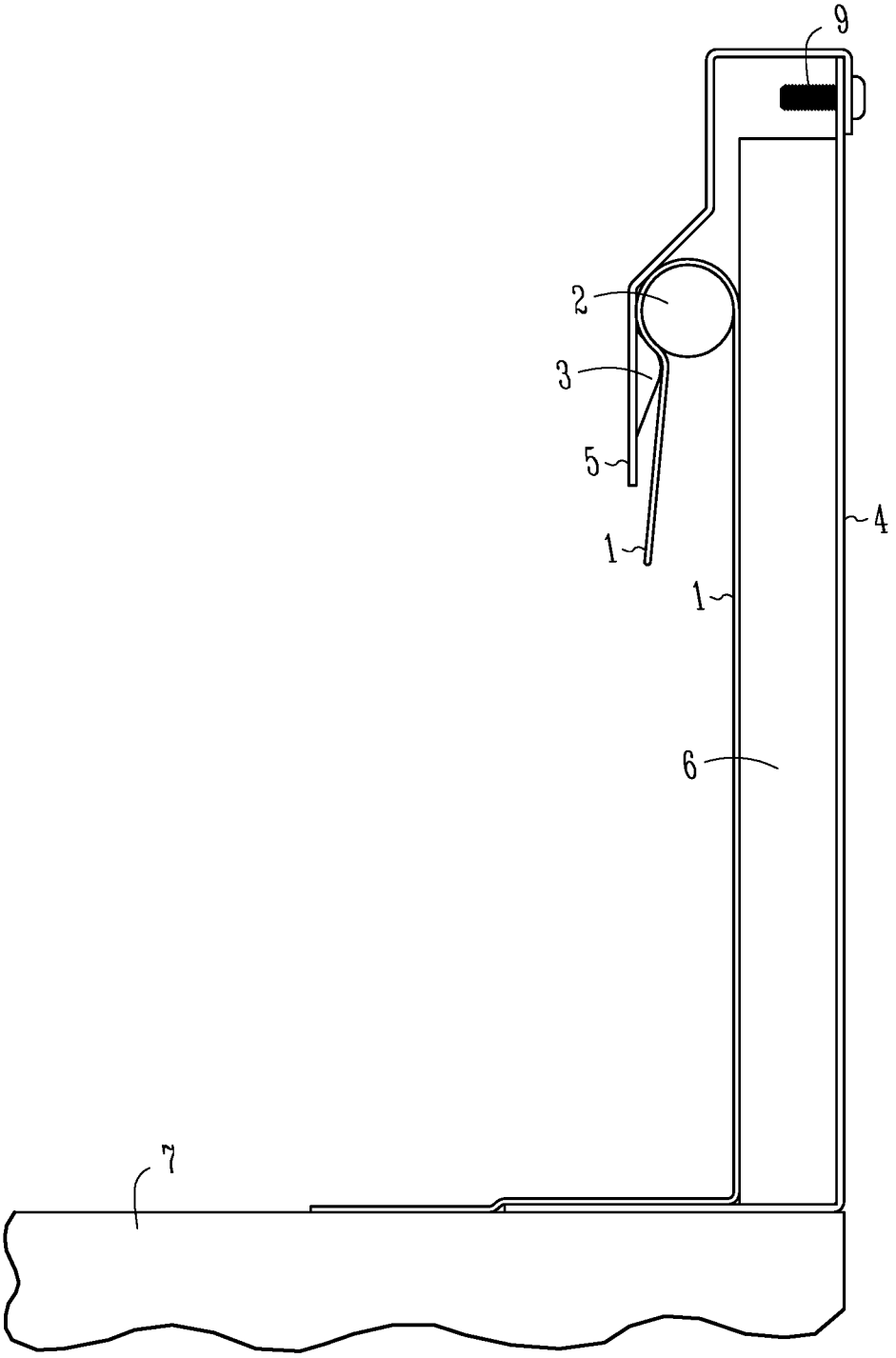
FIGS. 3A-B are cross-sectional views of a wall of the improved hatch assembly of FIG. 1, showing a single grip embodiment (FIG. 3A) and a plurality of grips embodiment (FIG. 3B), according to various embodiments of the present subject matter.
Figure 3B:
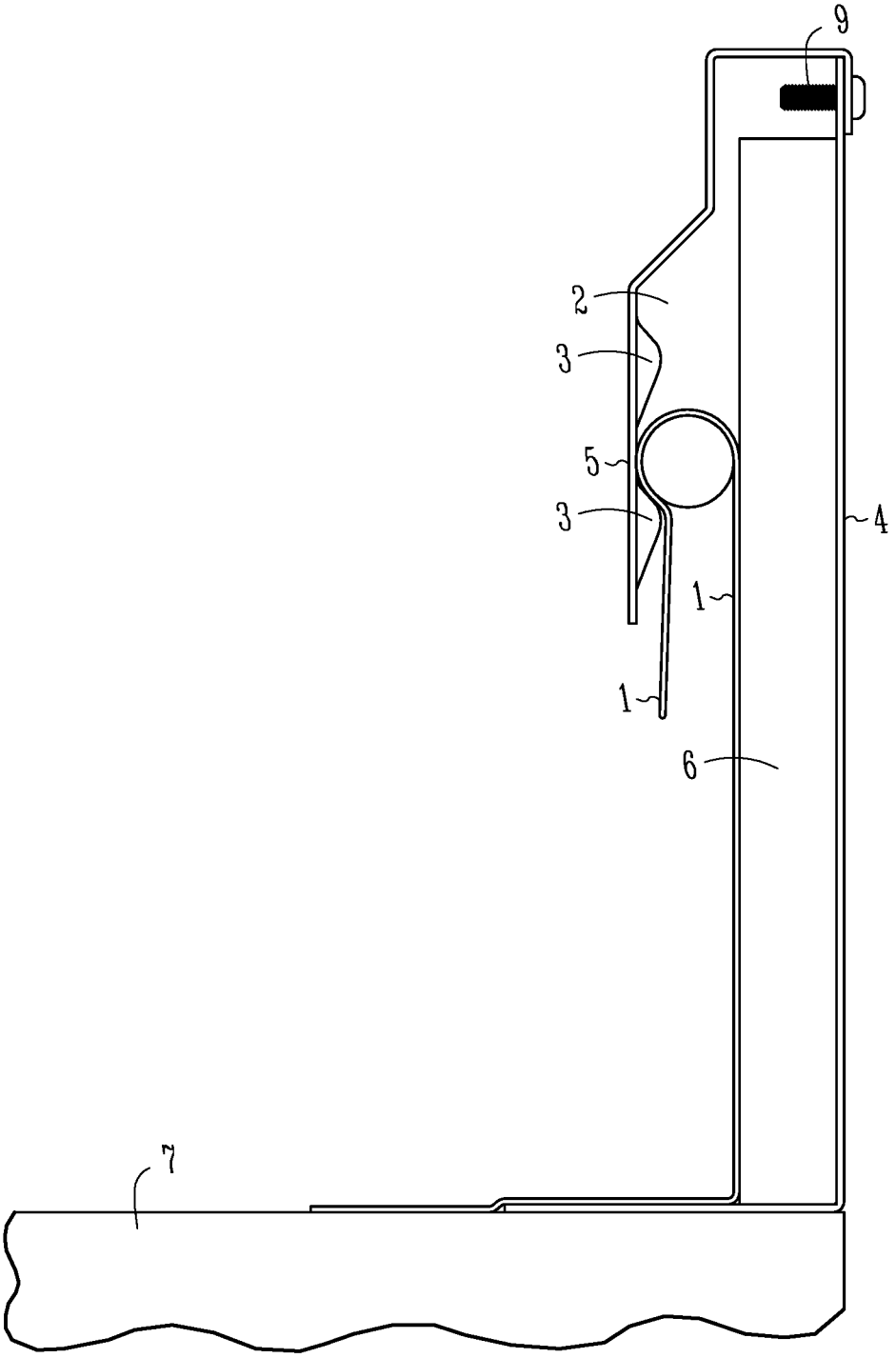

FIGS. 3A-B each show a cross section of the wall portion to demonstrate how a roof membrane is mated with the roof hatch assembly. FIGS. 3A-B are cross-sectional views of a wall of the improved hatch assembly of FIG. 1, showing a single grip embodiment (FIG. 3A) and a plurality of grips embodiment (FIG. 3B), according to various embodiments of the present subject matter, mounted on roof deck 7. The grips 3 disposed in counterflashing 5 provide easier, repeatable, and more rapid installation of the roofing membrane 1 using a supporting piece (commonly known as the "backer rod") 2. In various embodiments, grip 3 includes a preformed indentation, or emboss, into the counterflashing 5 used on the curb of roof equipment structures 4. The grips 3 mechanically hold the backer rod 2 which is attached to the roofing membrane 1 securely in place so as to maintain a proper weather seal and correct flashing height.

In various embodiments, the roofing membrane 1 may be affixed to insulation 6. In some embodiments, adhesive may be used to affix roofing membrane 1 to insulation 6. In such embodiments, the grips 3, when used with the backer rod 2, hold the membrane to allow the adhesive to set.

In various embodiments, a roofer will provide excess membrane material 1 around an opening in a roof. The roofer may also attach a backer rod 2 to the membrane. The membrane 1 may be gathered around the backer rod 2 and inserted into place under the counterflashing 5 to be engaged by the grips 3. This allows water, snow and ice to fall over the counterflashing 5 and onto the roofing material to provide a water resistant connection of the roofing material to any structure having the counterflashing 5 with grips 3. Therefore, when the hatch door 8 is closed, the roof hatch is waterproof because all moisture is directed away from the location where the assembly is connected to the roof using the membrane encircling the perimeter of the roof hatch using the backer rod 2 engaged in grips 3 with the membrane wrapped around it.

The grip 3 design includes a ramped edge, so the backer rod 2 glides up and snaps in place. The backer rod with membrane can be easily removed and reinstalled without damage to membrane or modifications to the roof equipment structure.

Unlike other existing approaches, the grip and backer rod approach of the present subject matter requires no special tools, nor complicated manipulation of the roof equipment structure, for installing the membrane. It also does not require highly skilled or trained labor and can be assembled with minimal instruction.

In various embodiments, the backer rod 2 is made of materials including, but not limited to one or more of the following: foam, wood, plastic, metal, pvc tubing, plexiglass, rubber, cork, and/or other form of rod material. The cross section of the backer rod 2 is demonstrated as being circular, but may be of several shapes, including, but not limited to one or more of circular, square, elliptical, c-shaped, flat, triangular, or other geometrical shape or combinations of shapes. The backer rod 2 is generally rigid in various embodiments; however, embodiments also may employ a deformable or slightly deformable rod material. In various embodiments, the backer rod is a bead of material that is long enough to encircle all or a portion of the opening of the roofing assembly. In various embodiments, the backer rod is a bendable polymer bead that can be inserted in place at different angles and depths according to the dimensions of the roofing assembly application. Other variations are possible without departing from the present subject matter.

The grips 3 may be made of different and varying shapes to accommodate different backer rods 2 and to accommodate different roofing membrane materials and thicknesses. The grips 3 may have multiple detents to allow for different roofing installations at different heights and tensions of the roofing material as the backer rod 2 is drawn up the side of the assembly. In various embodiments, the multiple detents allow for the backer rod to slide to a backstop position in case the membrane becomes taught due to temperature variations, shrinkage, and/or stress on the membrane from roofing materials, ice, water, and other objects, materials or substances. The grips 3 may be of different spacings to allow for grip placement near a corner for less leverage on the corner portion of the backer rod 2. In various embodiments, the grips 3 may include a manually operable portion to release the backer rod 2 so as to allow for greater tension when the backer rod is installed, yet less tension for when it is being removed so as to avoid damage to the membrane material. In one embodiment, the grips are manually separated to release the backer rod. In such embodiments, the grips may have a spring like nature to return to an original position after the grip is released. In various embodiments, the grip is relatively rigid and the backer rod material is compliant and/or compressible to allow the backer rod and membrane to be manually removed from the grips. Those of skill in the art will understand that a number of gripping mechanisms may be employed in various embodiments.

The counterflashing 5 may be made of metal, plastic, or other polymeric material. It is helpful that the counterflashing be resistant to one or more of the following, but not limited to: ultraviolet radiation common with sunlight, temperature variation, moisture, ozone, and other conditions and elements which the counterflashing 5 may be subject to in various installations. In various applications, it may be helpful to have the counterflashing 5 be electrically conductive or insulative. In various embodiments, the counterflashing 5 is attached to the roof assembly wall or curb 4. In various embodiments the counterflashing 5 is screwed in place around the roof assembly wall or curb 4. In various embodiments, the counterflashing is adhered to the roof assembly wall or curb 4. In various embodiments the counterflashing 5 is integrated into a single piece with the wall or curb 4. Thus, the screw 9 shown in FIG. 3 is exemplary and option, and other forms of attachment include, but are not limited to, one or more of attachment by clips, rivets, bonding, welding, spot welding, crimping, bolting, or other connection methods.

In various embodiments insulation 6 may be used against wall or curb 4 to control thermal loss of the roofing assembly. Different forms of insulation may be used, including, but not limited to one or more of, fiberglass insulation, foam insulation, wood, composite materials. In various applications, the insulation 6 provides a cushioned material that the backer rod 2 is biased against by grips 3. In various embodiments a hard material is employed at the top of the wall where the backer rod 2 is installed so as to avoid crushing or deforming the insulation. Other structures and applications and materials are possible without departing from the scope of the present subject matter.

For example, it is within the contemplation of the inventors that the present subject matter may be employed on a single side or multiple sides of a roofing apparatus to allow for rapid installation of a single side, multiple sides, or all sides of the roofing apparatus.

Figure 4:
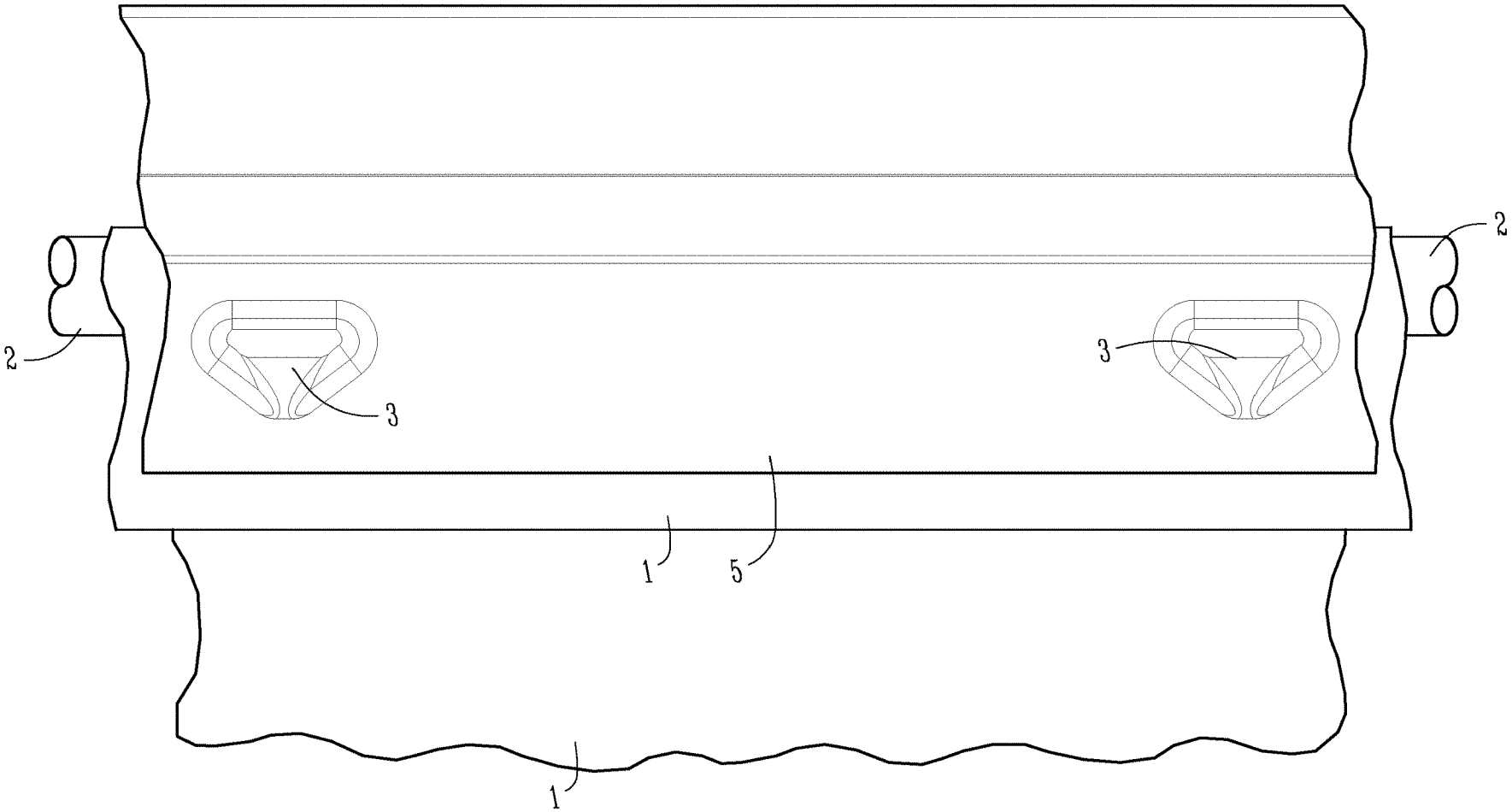
FIG. 4 is a side view of a wall of the improved hatch assembly of FIG. 3A, according to one embodiment of the present subject matter.
Figure 5:
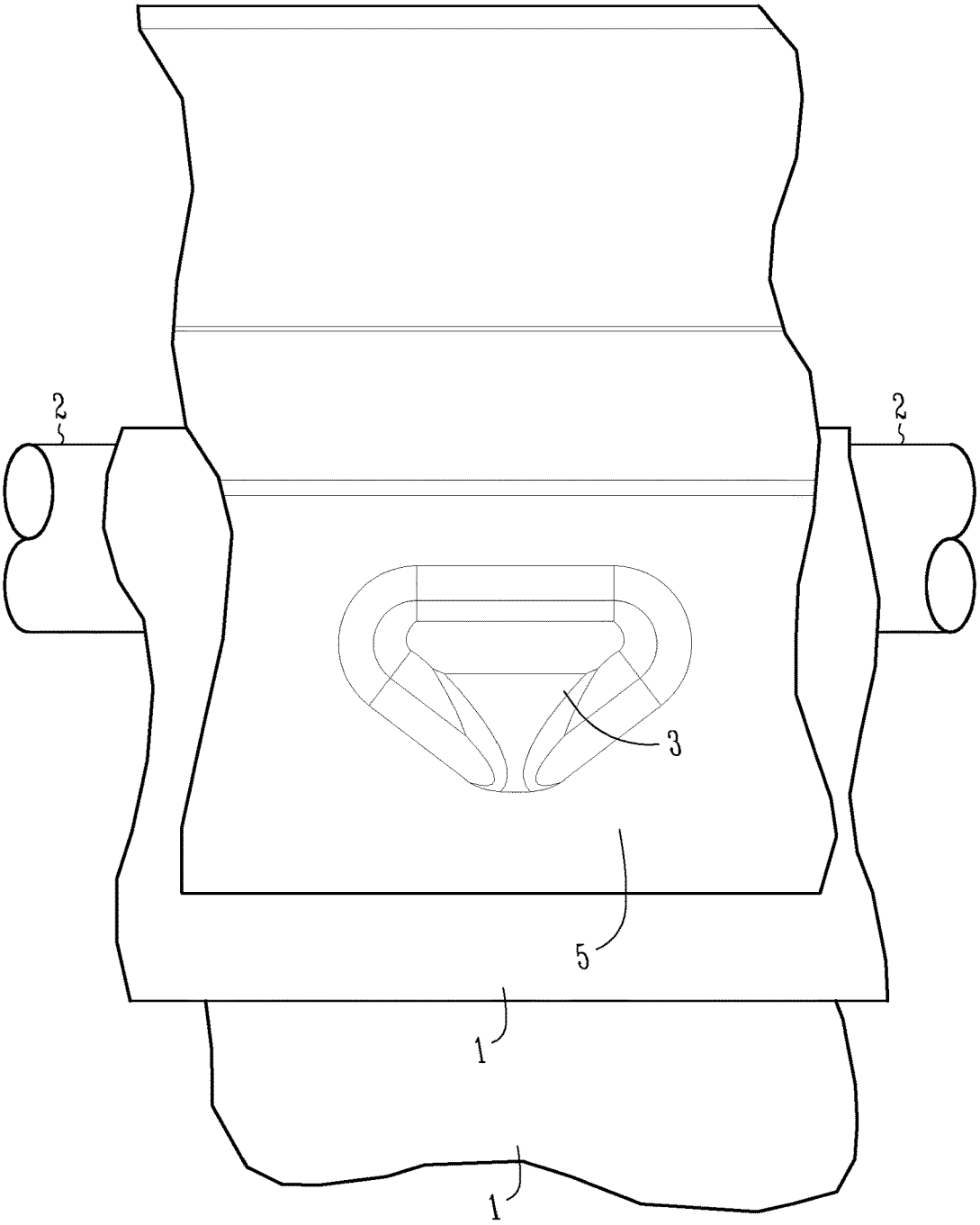
FIG. 5 is an exemplary view of a grip of the wall of FIG. 4, according to one embodiment of the present subject matter.

FIG. 4 is a side view of a wall of the improved hatch assembly of FIG. 3A, according to one embodiment of the present subject matter. This figure shows backer rod 2 with membrane 1 wrapped over it and held in position by grips 3 in counterflashing 5. FIG. 5 is an exemplary view of a grip of the wall of FIG. 4, according to one embodiment of the present subject matter. The shape, positioning, spacing, and configuration of grips 3 may vary as long as they provide sufficient force to hold backer rod 2 and membrane 1 in position. The examples provided by FIG. 4 and FIG. 5 are used to demonstrate one application of the present subject matter.

EXAMPLES

In various examples, the present subject matter provides apparatus for connecting a roof assembly to a membrane using at least one backer rod connected to the membrane, including: counterflashing disposed about the perimeter of the roof assembly, the counterflashing including a plurality of grips configured to receive and engage the at least one backer rod in contact with the membrane, so as to hold the membrane securely in position and maintain a weather seal at a desired flashing height of the membrane. In various examples, at least some of the plurality of grips include detents to hold at least some of the at least one backer rod. In various examples, at least some of the plurality of grips include multiple detents to hold at least some of the at least one backer rod at different heights and/or different tensions. In various examples, the detents include a manually operable portion to allow for release of tension on the at least some of the at least one backer rod for removal. A variety of backer rod materials may be employed in various examples. In examples where the grips are relatively fixed, the backer rod can be made of a flexible or compressible material so as to allow the backer rod to be placed into the grips and hold the membrane in place. In examples where the grips are more flexible, a more rigid backer rod can be inserted into the grips to hold the membrane in place. A person of skill in the art will appreciate that the grips and backer rod can be selected to allow for a firm hold on the membrane, and to allow for removal of the backer rod as needed to release the membrane from the roof structure. Thus, the grips and backer rod can be made of different dimensions and materials in various examples.

In various examples, at least some of the plurality of grips include a ramped edge to allow the at least one backer rod to snap into place and to hold the backer rod. In various examples, different materials can be used for the counterflashing. In some examples, at least a portion of the counterflashing includes metal. In various examples, different attachment means may be employed. In some examples at least a portion of the counterflashing is screwed to the roof assembly. In various examples, the roof assembly includes a roof hatch, window, or other fenestration unit.

In various examples, the present subject matter provides a hatch attached to a wall forming an opening in an open state, and sealing the opening in a closed state, the hatch configured to at least partially engage with a portion of the wall comprising a counterflashing configured to receive and hold at least one backer rod connected to a roof membrane, the counterflashing disposed about the perimeter of the roof assembly, the counterflashing including a plurality of grips configured to receive and engage the at least one backer rod in contact with the membrane, so as to hold the membrane securely in position and maintain a weather seal at a desired flashing height of the membrane, wherein the at least one backer rod is compressible to be inserted into the plurality of grips to hold the backer rod and membrane in position.

In various examples, the present subject matter provides a method for operating a roof assembly for connection to a roof membrane, comprising: gathering the roof membrane about one or more backer rods; and inserting the roof membrane and backer rods into a plurality of grips of a counterflashing disposed about a perimeter of the roof assembly so as to provide a tension and height to the roof membrane to seal the roof assembly to the roof membrane. In various examples, the method includes gluing the roof membrane to insulation of the roof assembly to provide a water resistant seal.

The above description includes references to the accompanying drawings, which form a part of the detailed description. The drawings show, by way of illustration, varying embodiments in which the invention can be practiced. The application also refers to "examples." Such examples can include elements in addition to those shown or described.

The foregoing examples and embodiments are not intended to be an exhaustive or exclusive list of examples and variations of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. Apparatus for connecting a roof assembly to a membrane using at least one backer rod connected to the membrane, comprising:

counterflashing disposed about the perimeter of the roof assembly, the counterflashing including a plurality of grips to receive and engage the at least one backer rod in contact with the membrane, the plurality of grips comprising detents formed by indentations or embossments, the plurality of grips configured such that the at least one backer rod is inserted and snapped in place so as to hold the membrane securely in position and maintain a weather seal at a desired flashing height of the membrane, wherein at least some of the plurality of grips include triangular shaped detents to hold at least some of the at least one backer rod.

2. The apparatus of claim 1, wherein the detents include a manually operable portion to allow for release of tension on the at least some of the at least one backer rod for removal.

3. The apparatus of claim 1, wherein at least some of the plurality of grips include multiple detents to hold at least some of the at least one backer rod at different heights.

4. The apparatus of claim 1, wherein the detents include a manually operable portion to allow for release of tension on the at least some of the at least one backer rod for removal.

5. The apparatus of claim 1, wherein at least some of the plurality of grips include multiple detents to hold the membrane at different heights.

6. The apparatus of claim 5, wherein the detents include a manually operable portion to allow for release of tension on the at least some of the at least one backer rod for removal.

7. The apparatus of claim 1, wherein at least some of the plurality of grips include multiple detents to hold the membrane at different tensions.

8. The apparatus of claim 7, wherein the detents include a manually operable portion to allow for release of tension on the at least some of the at least one backer rod for removal.

9. The apparatus of claim 1, wherein at least some of the plurality of grips are configured to hold one or more backer rods of a circular cross section.

10. The apparatus of claim 1, wherein at least some of the plurality of grips are configured to hold one or more backer rods of a non-circular cross section.

11. The apparatus of claim 1, wherein at least some of the plurality of grips include a ramped edge to allow the at least one backer rod to snap into place to hold the backer rod.

12. The apparatus of claim 1, wherein at least some of the plurality of grips include a manually operable portion to allow for release of tension on the backer rod for removal of the backer rod.

13. The apparatus of claim 1, wherein at least a portion of the counterflashing includes metal.

14. The apparatus of claim 1, wherein at least a portion of the counterflashing is screwed to the roof assembly.

15. The apparatus of claim 1, wherein the roof assembly includes a roof hatch.

16. The apparatus of claim 1, wherein the roof assembly includes a window.

17. A roof hatch, comprising:

a hatch attached to a wall forming an opening in an open state, and sealing the opening in a closed state, the hatch configured to at least partially engage with a portion of the wall comprising a counterflashing configured to receive and hold at least one backer rod connected to a roof membrane, the counterflashing disposed about the perimeter of the hatch, the counterflashing including a plurality of grips formed by indentations or embossments to receive and engage the at least one backer rod in contact with the membrane, the plurality of grips configured such that the at least one backer rod is inserted and snapped in place so as to hold the membrane securely in position and maintain a weather seal at a desired flashing height of the membrane, wherein the at least one backer rod may be manually inserted into the plurality of grips to hold the backer rod and membrane in position, and wherein at least some of the plurality of grips include triangular shaped detents to hold at least some of the at least one backer rod.

18. The apparatus of claim 17, wherein at least a portion of the counterflashing is metal.

19. The apparatus of claim 17, wherein the at least one backer rod includes at least a portion made of foam.

20. A method for operating a roof assembly for connection to a roof membrane, comprising:

gathering the roof membrane about one or more backer rods; and inserting the roof membrane and one or more backer rods into a plurality of grips of a counterflashing, the plurality of grips formed by indentations or embossments and disposed about a perimeter of the roof assembly, the plurality of grips configured such that the one or more backer rods are inserted and snapped in place so as to provide a tension and height to the roof membrane to seal the roof assembly to the roof membrane, wherein at least some of the plurality of grips include triangular shaped detents to hold at least some of the one or more backer rods.

21. The method of claim 20, wherein the one or more backer rods are made of a compressible material.

22. The method of claim 20, further comprising releasing an operable portion of the plurality of grips to remove the membrane and the one or more backer rods.

23. The method of claim 20, further comprising gluing the roof membrane to insulation of the roof assembly to provide a water resistant seal.

* * * * *